US010763610B2

(12) United States Patent
Bae et al.

(10) Patent No.: US 10,763,610 B2
(45) Date of Patent: Sep. 1, 2020

(54) MALE CONNECTOR AND CONNECTOR ASSEMBLY COMPRISING THE SAME

(71) Applicant: Tyco Electronics AMP Korea Co., Ltd., Gyungsan-si (KR)

(72) Inventors: Jae Yong Bae, Gyungsan-si (KR); Sang Ho Jang, Gyungsan-si (KR)

(73) Assignee: Tyco Electronics AMP Korea Co., Ltd., Gyungsan-Si (KR)

( * ) Notice: Subject to any disclaimer, the term of this patent is extended or adjusted under 35 U.S.C. 154(b) by 0 days.

(21) Appl. No.: 16/357,816

(22) Filed: Mar. 19, 2019

(65) Prior Publication Data

US 2019/0288439 A1 Sep. 19, 2019

(30) Foreign Application Priority Data

Mar. 19, 2018 (KR) ..... 10-2018-0031626
Jan. 30, 2019 (KR) ..... 10-2019-0012100

(51) Int. Cl.
*H01R 13/502* (2006.01)
*H01R 13/453* (2006.01)
*H01R 13/629* (2006.01)

(52) U.S. Cl.
CPC ..... *H01R 13/4538* (2013.01); *H01R 13/502* (2013.01); *H01R 13/62938* (2013.01)

(58) Field of Classification Search
CPC ..... H01R 13/502; H01R 13/4538; H01R 13/62938
USPC ..... 439/140
See application file for complete search history.

(56) References Cited

U.S. PATENT DOCUMENTS 5,269,696 A * 12/1993 Okada ..... H01R 13/62933 439/140
6,193,531 B1 * 2/2001 Ito ..... H01R 13/62933 439/140
6,761,568 B2 * 7/2004 Bakker ..... H01R 13/4538 439/140
6,846,191 B2 * 1/2005 Hobbs ..... H01R 13/4538 439/140

(Continued)

FOREIGN PATENT DOCUMENTS

KR 10-2015-0140262 12/2015
KR 20180010934 A 1/2018

OTHER PUBLICATIONS

Abstract of KR 10-2015-0140262, dated Dec. 15, 2015, 1 page.

(Continued)

*Primary Examiner* — Abdullah A Riyami
*Assistant Examiner* — Vladimir Imas
(74) *Attorney, Agent, or Firm* — Barley Snyder

(57) ABSTRACT

A connector assembly comprises a male connector and a female connector. The male connector includes a cap housing, an access terminal accommodated in the cap housing, a connecting part fixably mounted in the cap housing, and a protection part configured to be movable relative to the connecting part in a lengthwise direction of the access terminal. The female connector includes a plug housing configured to insert in the cap housing. The plug housing is configured to release a fastening state between the connecting part and the protection part and to push the protection part toward a floor surface of the connecting part during coupling of the male connector and the female connector.

20 Claims, 18 Drawing Sheets

(56) References Cited

U.S. PATENT DOCUMENTS 6,896,531 B2 * 5/2005 Bakker ..... H01R 13/4538 439/140
7,134,901 B2 * 11/2006 Okura ..... H01R 13/4538 439/372
7,249,958 B2 * 7/2007 Ishikawa ..... H01R 13/631 439/140
7,329,133 B2 * 2/2008 Ishikawa ..... H01R 13/62938 439/140
7,524,200 B2 * 4/2009 Ikeya ..... H01R 13/62938 439/157
8,075,351 B2 12/2011 Park et al.
9,099,808 B2 * 8/2015 Kato ..... H01R 13/4538
9,147,964 B2 * 9/2015 Kato ..... H01R 13/533
9,455,521 B2 9/2016 Bang et al.
9,509,081 B2 * 11/2016 Kobayashi ..... H01R 13/506
9,520,669 B2 * 12/2016 Gerwatowski ..... H01R 13/44
9,520,675 B2 12/2016 Choi et al.
9,608,357 B1 * 3/2017 Sundarakrishnamachari ..... H01R 13/4534
9,812,807 B2 * 11/2017 Matsuura ..... H01R 13/502
9,812,813 B1 * 11/2017 Sakamoto ..... H01R 13/502
9,824,837 B2 * 11/2017 Ooishi ..... H01R 13/62938
9,948,030 B1 * 4/2018 Faulkner ..... H01R 13/6335
9,972,937 B2 * 5/2018 Akagi ..... H01R 13/62938
10,038,279 B2 * 7/2018 Suzuki ..... H01R 13/631
10,135,183 B1 * 11/2018 Probert ..... H01R 13/62938
10,305,223 B2 * 5/2019 Tashiro ..... H01R 13/501
10,340,621 B2 * 7/2019 Hirota ..... H01R 13/4538
2006/0205264 A1 9/2006 Katsuma
2017/0244191 A1 8/2017 Furuya et al.

OTHER PUBLICATIONS

Extended European Search Report, European Patent Application No. 19162448.5, dated Oct. 9, 2019, 9 pages.
Abstract and English translation of KR 20180010934 A, dated Jan. 31, 2018, 17 pages.

* cited by examiner

MALE CONNECTOR AND CONNECTOR ASSEMBLY COMPRISING THE SAME

CROSS-REFERENCE TO RELATED APPLICATIONS

This application claims the benefit of the filing date under 35 U.S.C. § 119(a)-(d) of Korean Patent Application No. 10-2018-0031626, filed on Mar. 19, 2018, and Korean Patent Application No. 10-2019-0012100, filed on Jan. 30, 2019.

FIELD OF THE INVENTION

The present invention relates to a connector and, more particularly, to a male connector.

BACKGROUND

A connector permits selective connection or disconnection of an electrical connection. The connector can be used in various types of electronic mechanical devices, for example, vehicles and home appliances, and used for electrical connection and/or physical connection between a plurality of electrical parts. Damage can occur to an access terminal of a connector by misalignment of the access terminal, and fluid or foreign substances can also flow into the connector.

A connector assembly according to the prior art, disclosed in Korean Patent Application Publication No. 10-2015-0140262, is shown in FIG. 18. As shown to FIG. 18, the connector assembly includes a protection plate 90 supported by a protection plate locking member 82 mounted in a cap housing 80. A locking recess 92 configured to lock the protection plate locking member 82 is formed on an outer side of the protection plate 90. The protection plate locking member 82 has a shape that protrudes toward a center portion of the cap housing 80. To manufacture the shape through an injection molding method, a core hole H is formed in an edge of the cap housing 80. The core hole H needs to be waterproofed for waterproofing of the connector assembly. In addition, for waterproofing the core hole H and a plurality of stepped ports on the same area, a size of the connector assembly increases.

SUMMARY

A connector assembly comprises a male connector and a female connector. The male connector includes a cap housing, an access terminal accommodated in the cap housing, a connecting part fixably mounted in the cap housing, and a protection part configured to be movable relative to the connecting part in a lengthwise direction of the access terminal. The female connector includes a plug housing configured to insert in the cap housing. The plug housing is configured to release a fastening state between the connecting part and the protection part and to push the protection part toward a floor surface of the connecting part during coupling of the male connector and the female connector.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
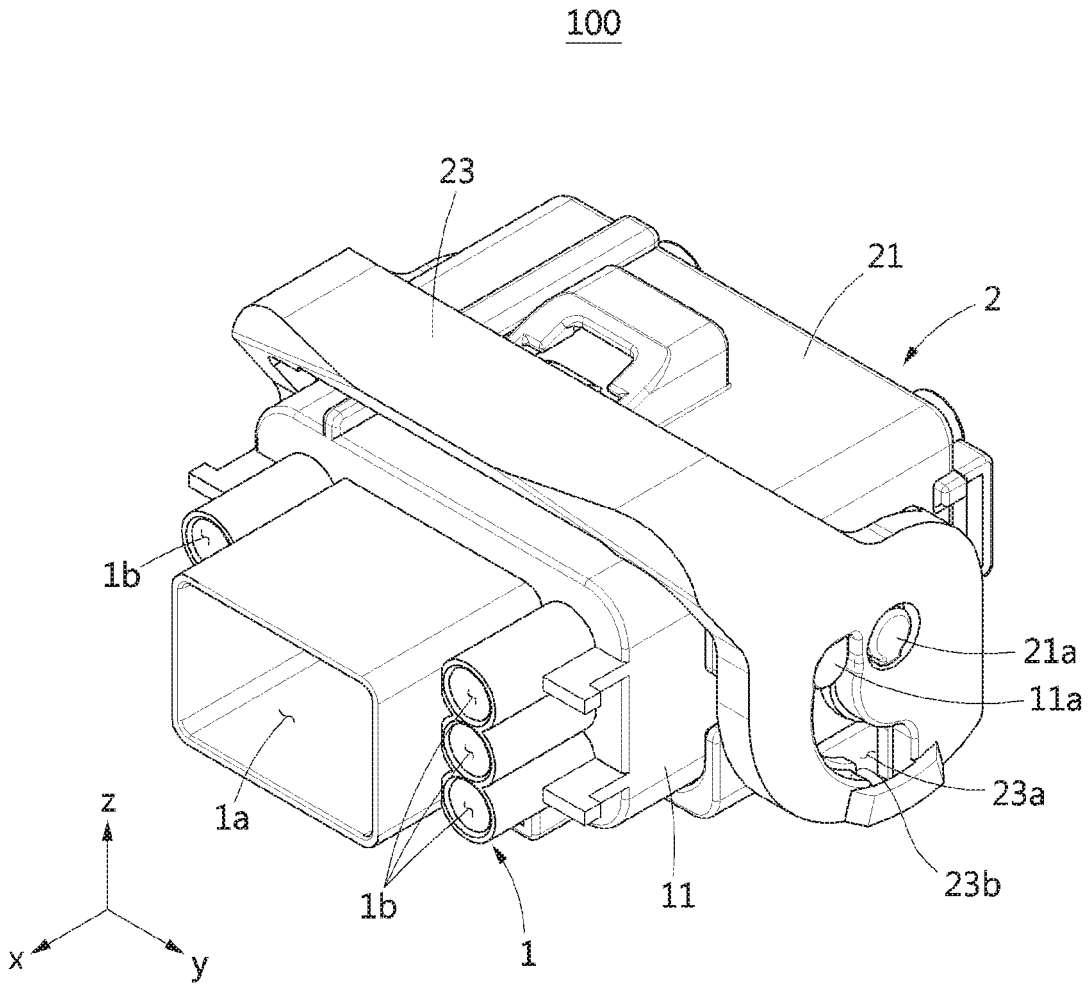
FIG. 1 is a perspective view of a connector assembly.

Hereinafter, exemplary embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

A component having a common function with a component included in one example embodiment is described using a like name in another example embodiment. Unless otherwise described, a description made in one example embodiment may be applicable to another example embodiment and a detailed description within a duplicate range is omitted.

Figure 2:
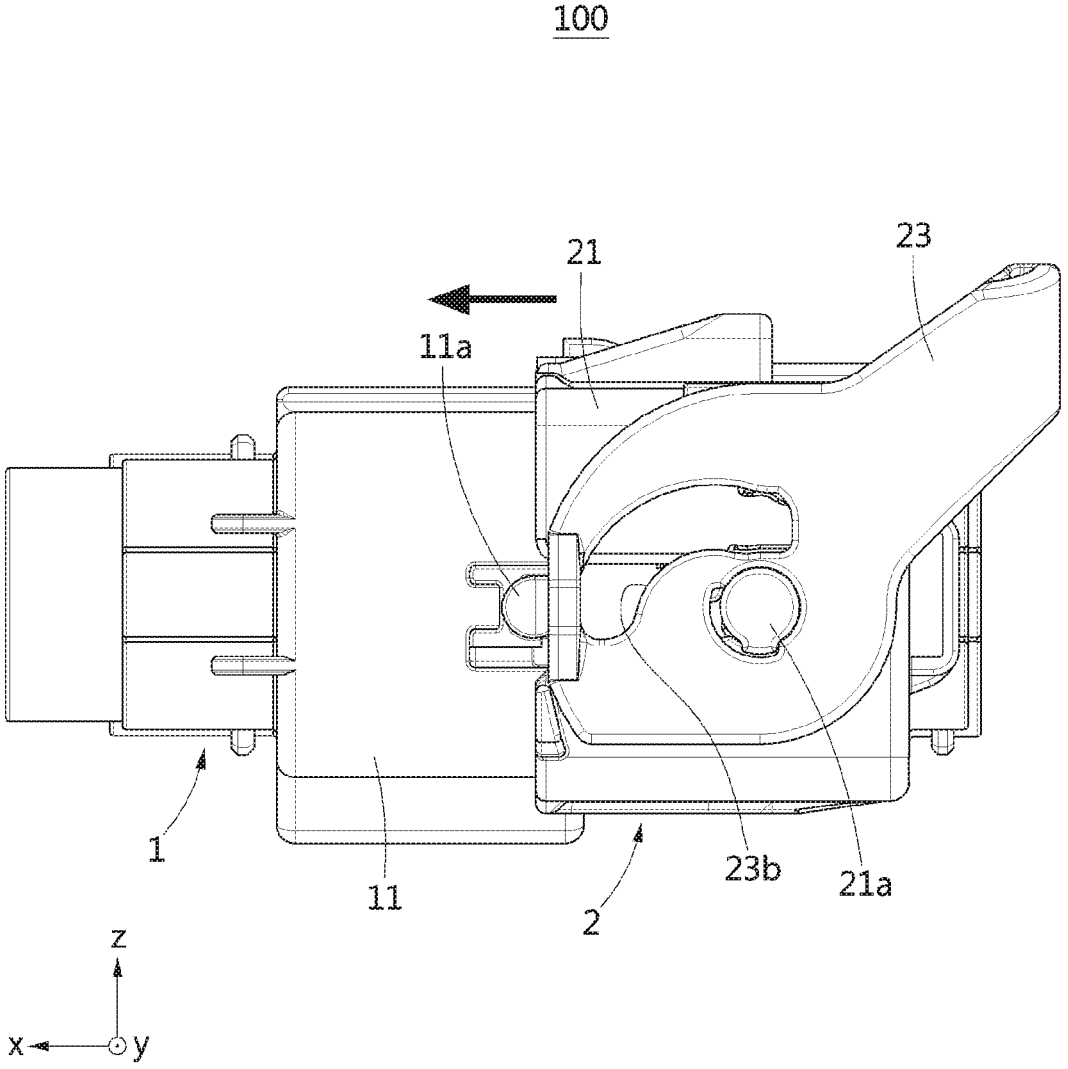
FIG. 2 is a side view of the connector assembly in a state in which a female connector and a male connector are not coupled.
Figure 3:
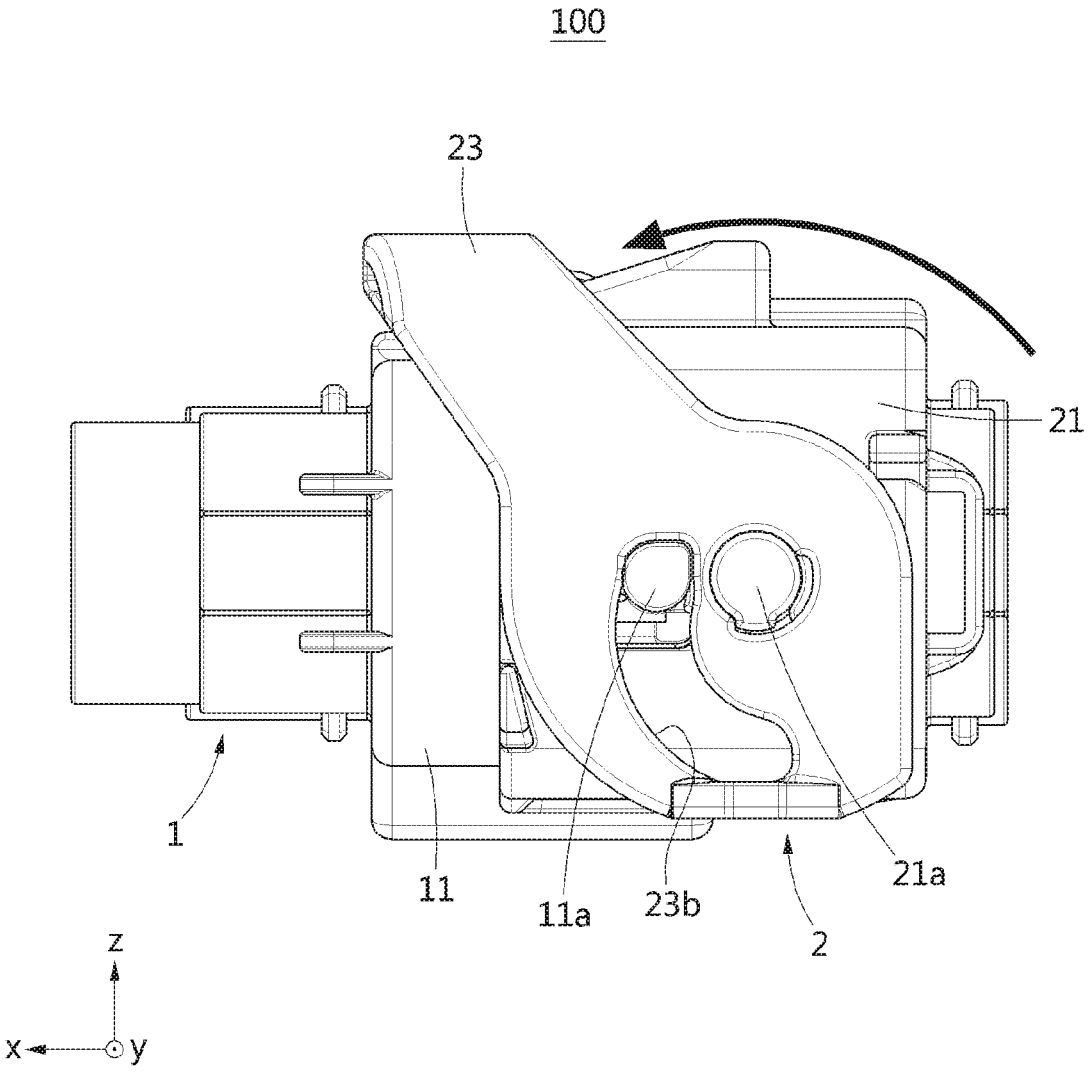
FIG. 3 is a side view of the connector assembly in a state in which the female connector and the male connector are coupled.

A connector assembly 100 according to an embodiment, as shown in FIGS. 1-3, comprises a male connector 1 and a female connector 2 capable of being coupled with or separated from each other. The connector assembly 100 creates an electrical connection and/or a physical connection between a plurality of electronic parts. In an embodiment, the male connector 1 is electrically and/or physically connected to a first electronic part and the female connector 2 is electrically and/or physically connected to a second electronic part. Through mutual physical coupling, the male connector 1 and the female connector 2 connect the plurality of electronic parts.

The male connector 1, as shown in FIGS. 1-3, include a cap housing 11. The cap housing 11 may be open toward a front (+x-axial direction) and a rear (−x-axial direction). A rear opening of the male connector 1 may be covered by the female connector 2. A front opening of the male connector 1 may include a main opening 1*a* configured to surround an access terminal 12, shown in FIG. 4, and a plurality of assistance openings 1*b* configured to accommodate other wires. A seal may insert into the main opening 1*a* and the assistance openings 1*b* and may prevent water or foreign substances from flowing in from an outside through the front opening of the male connector 1.

The female connector 2, as shown in FIGS. 1-3, may be provided to the male connector 1. The female connector 2 is slidable along an outer side of the male connector 1. The female connector 2 may include a case 21 and a connector lever 23. The case 21 may include a case protrusion 21*a* configured to protrude, for example, in a direction (y-axial direction) perpendicular to a direction (x-axial direction) in which the female connector 2 slides.

As shown in FIGS. 1-3, the cap housing 11 may include an outer protrusion 11*a* configured to protrude in the y-axial direction. The connector lever 23 may be rotatably connected to the case protrusion 21*a*. The connector lever 23 may adjust a distance between the case protrusion 21*a* and the outer protrusion 11*a* to assist coupling of the cap housing 11 and the case 21.

The connector lever 23, as shown in FIGS. 1-3, may include a lever opening 23*a* configured to accommodate the outer protrusion 11*a* and a lever guide 23*b* configured to set a travel route of the outer protrusion 11*a*. When the outer protrusion 11*a* is verified to be inserted into the lever guide 23*b*, a user may rotate the connector lever 23 in a direction (counterclockwise around the y axis) indicated by an indicator with an arrow head of FIG. 3. During rotation of the connector lever 23, the outer protrusion 11*a* may become closer to the case protrusion 21*a*. Unless the connector lever 23 rotates clockwise based on the y axis, the male connector 1 and the female connector 2 may maintain the coupled state.

A waterproof structure is provided when coupling the male connector 1 and the female connector 2. If a core hole H is formed as in the prior art in FIG. 18, a separate waterproof structure for sealing the core hole H is required. In the connector assembly 100, the above issue is avoided by providing the core hole to the main opening 1*a*, as described in greater detail below; the separate waterproof structure for sealing the core hole is not required.

Figure 5:
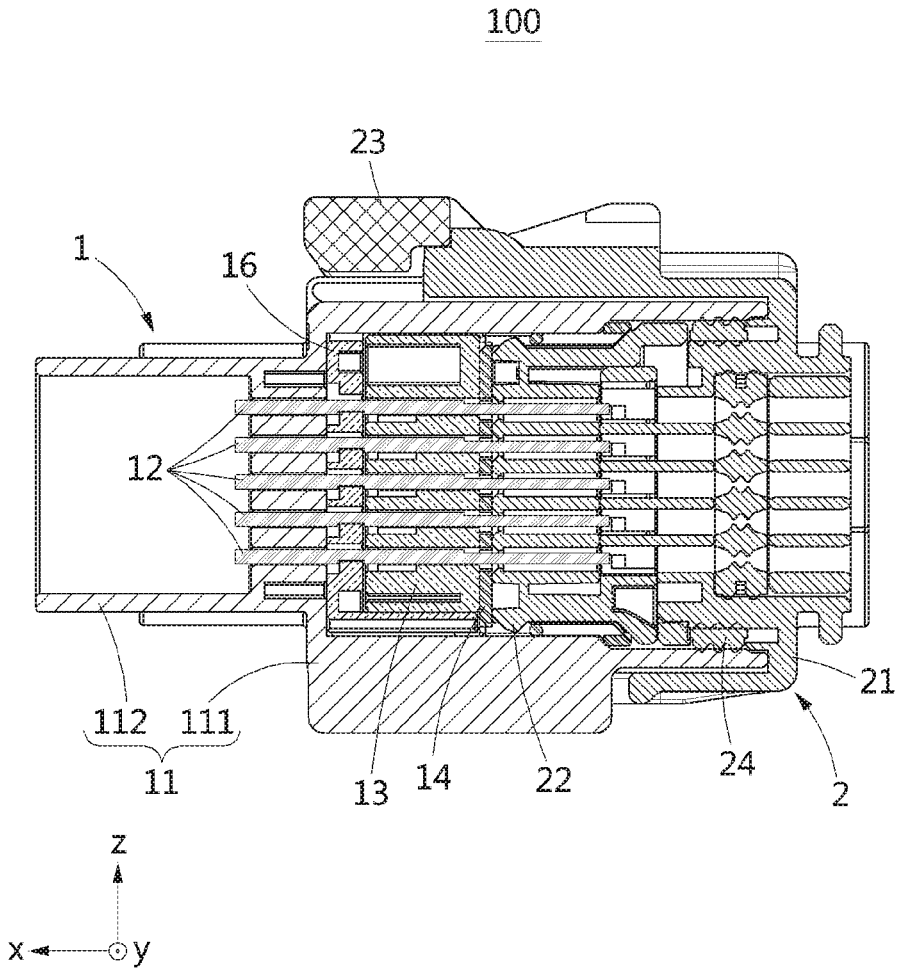
FIG. 5 is a sectional side view of the connector assembly in the state in which the female connector and the male connector are coupled.
Figure 6:
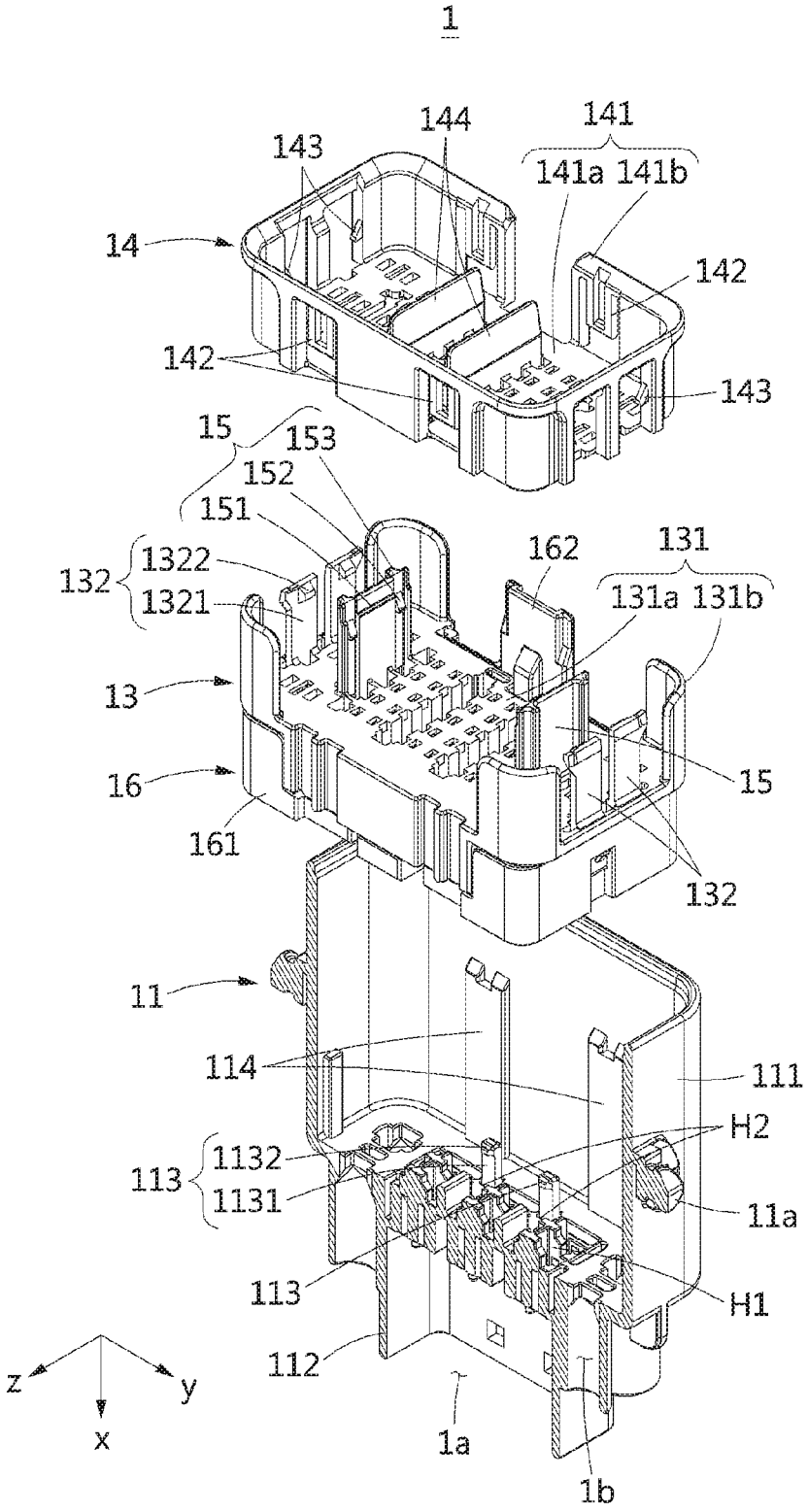
FIG. 6 is an exploded perspective view of the male connector.
Figure 7:
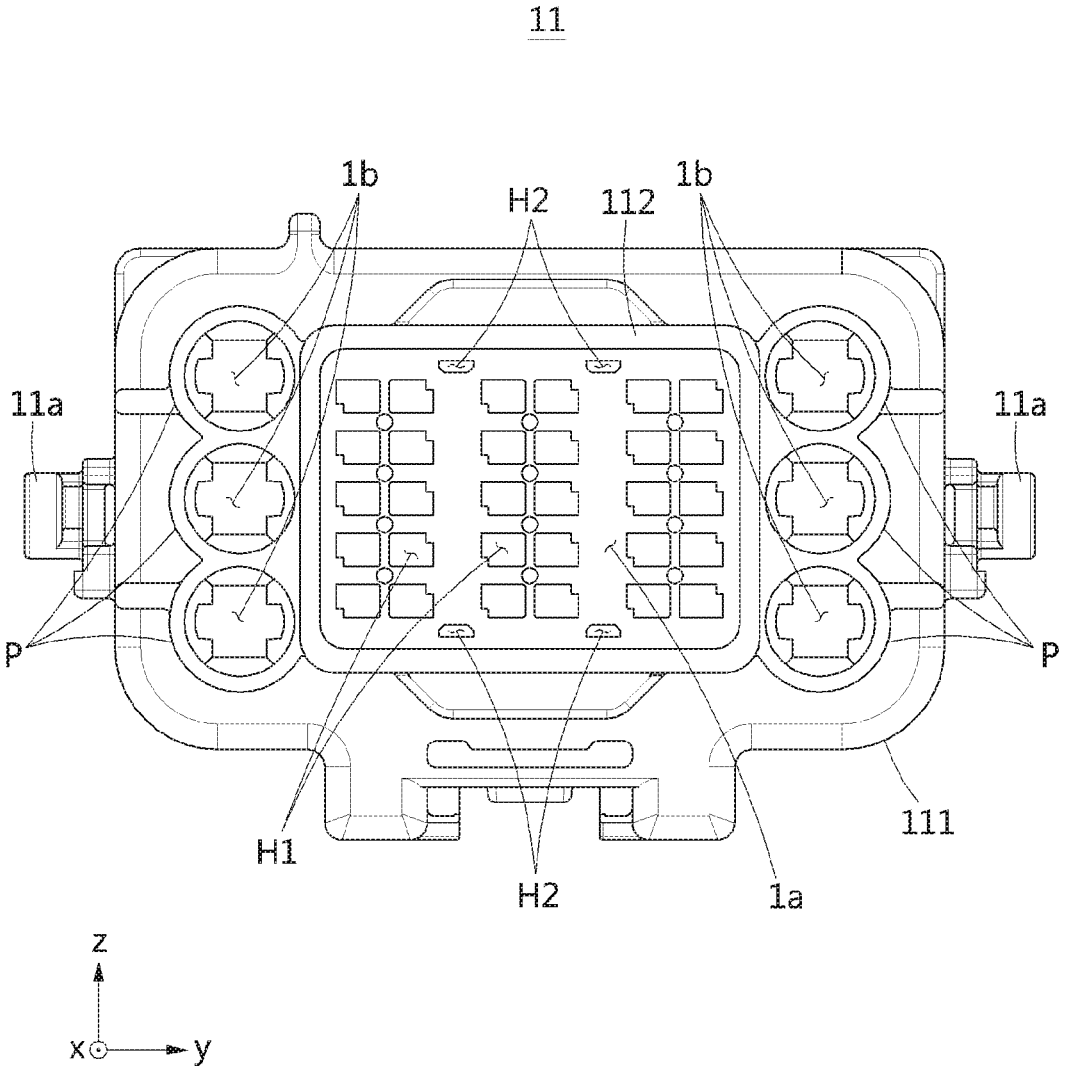
FIG. 7 is a front view of a cap housing of the male connector.
Figure 8:
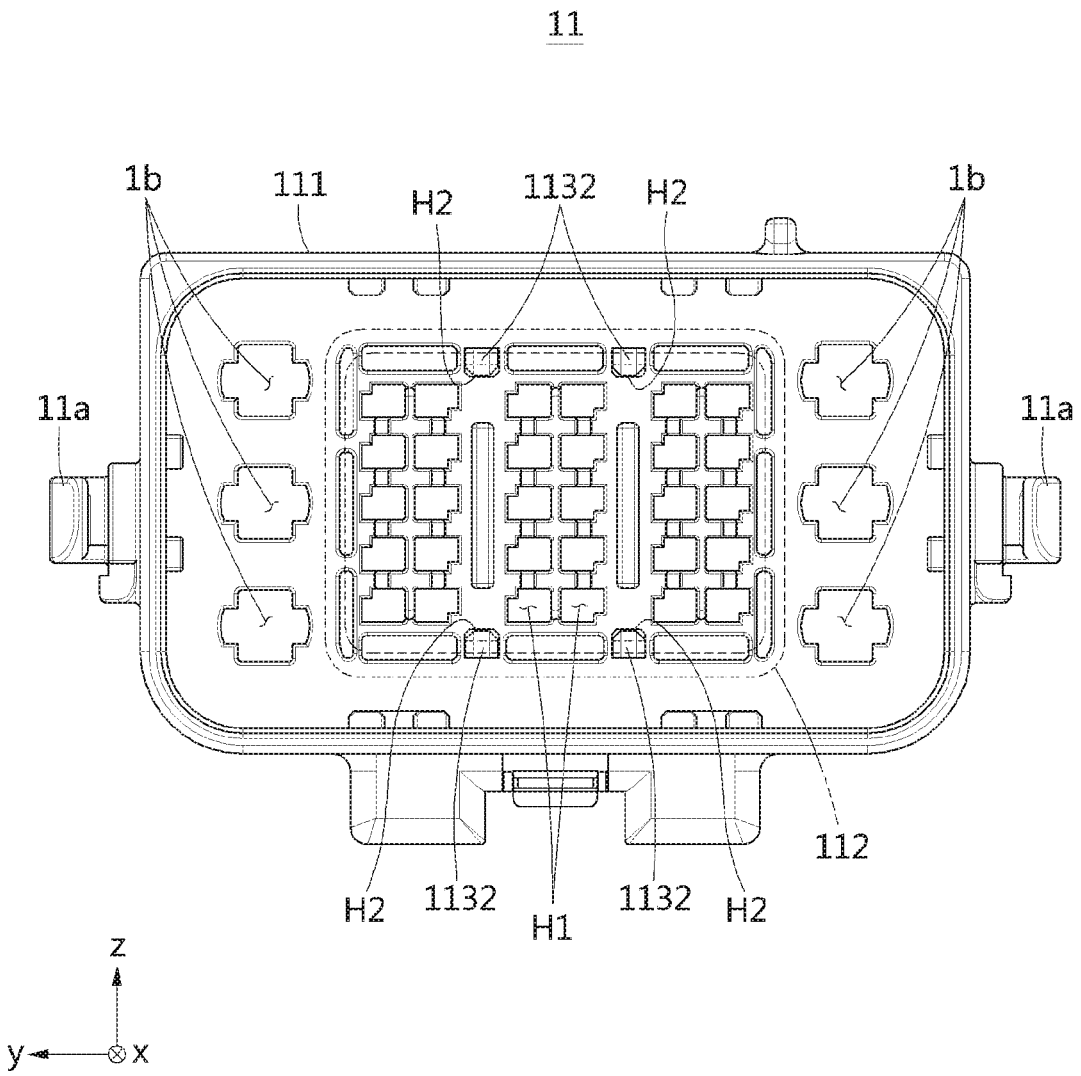
FIG. 8 is a rear view of the cap housing.

In the connector assembly 100, a core hole H2 is provided to the main opening 1*a*, as shown in FIGS. 6-8. According to this structure, a separate configuration for sealing the core hole H2 is not required. The core hole H2 indicates a hole that is unavoidably formed while forming a cap protrusion 113. To provide the core hole H2 to the main opening 1*a*, the cap protrusion 113 needs to be separate from an inner sidewall of the cap housing 11 by a desired distance. To provide the connector assembly 100 in a compact structure, a support rod 132 may be maximally proximate to the inner sidewall of the cap housing 11. Accordingly, the connector assembly 100 includes a connecting part 13 as shown in FIGS. 4-6 and 9. A protection part 14 of the connector assembly 100 is understood to slide vertically relative to the connecting part 13 that is configured to fasten to the cap housing 11, instead of directly sliding vertically relative to the cap housing 11. According to the above structure, the compact structure may be implemented by providing the support rod 132 to be proximate to the inner sidewall of the cap housing 11 while providing the core hole H2 to the main opening 1*a*.

As shown in FIGS. 4-9, the connector assembly 100 may include the male connector 1, the female connector 2, and an inner seal 24. The male connector 1 may include the cap housing 11, the access terminal 12, the connecting part 13, the protection part 14, a coupling part 15, and a slider 16.

Figure 18:
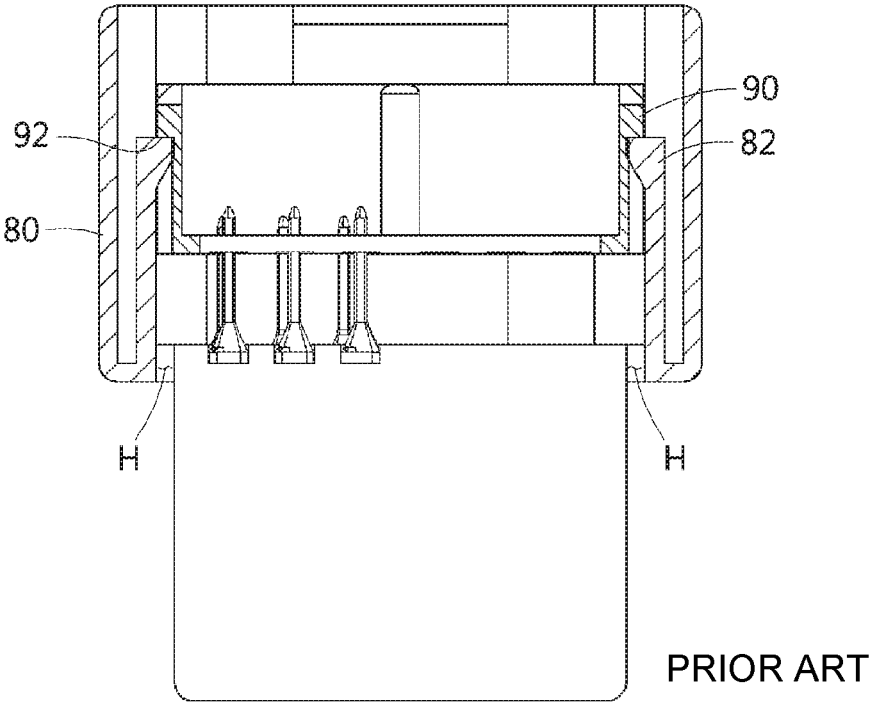
FIG. 18 is a sectional side view of a connector assembly according to the prior art.

In FIG. 18, because the protection plate locking member 82 and the cap housing 80 are integrally formed in the prior art, the core hole H corresponding to the protection plate locking member 82 is formed in the cap housing 80. In the connector assembly 100 according to the present invention, by manufacturing the cap housing 11 and the connecting part 13 as separate members and then assembling the same, the core hole H may be formed in not the cap housing 11 but the connecting part 13. Here, the cap protrusion 113 is simply only an example of the "fastening structure" that is a configuration configured to fasten the connecting part 13 to the cap housing 11. As described above, the cap housing 11 and the connecting part 13 are manufactured as separate members and then assembled, and when the protection part 14 ascends or descends relatively with respect to the cap housing 11, the connecting part 13 may not move relative to the cap housing 11 by way of the fastening structure that fastens the cap housing 11 and the connecting part 13 to each other.

The fastening structure is configured to fasten the cap housing 11 and the connecting part 13 to each other. Although the fastening structure is described hereinafter as the cap protrusion 113 that is a lower configuration of the cap housing 11, it is provided as an example only. In other embodiments, the fastening structure may be a protrusion that protrudes from the connecting part 13 and fastens to the cap housing 11.

Figure 4:
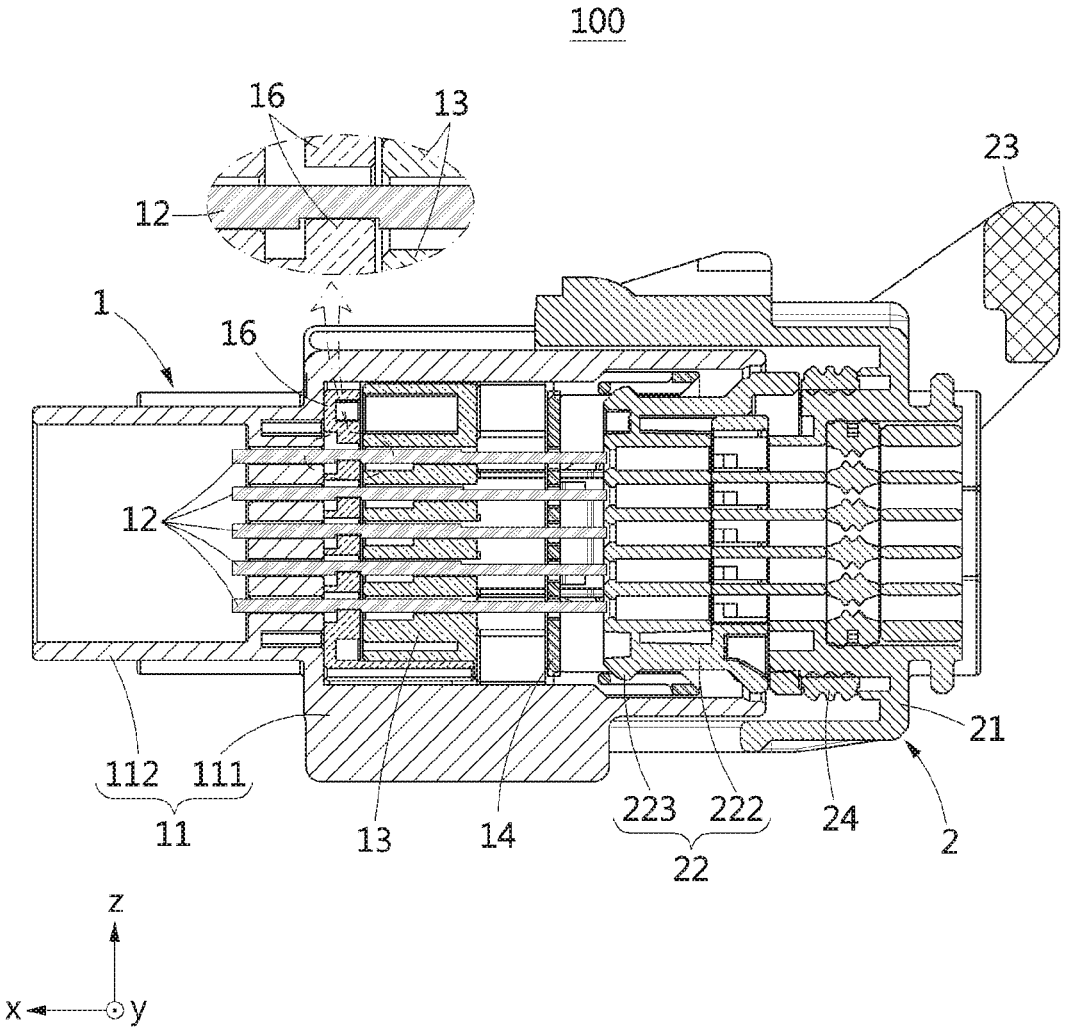
FIG. 4 is a sectional side view of the connector assembly in the state in which the female connector and the male connector are not coupled.

The cap housing 11 may accommodate the access terminal 12, the connecting part 13, the protection part 14, the coupling part 15, and the slider 16, as shown in FIGS. 4-6. The cap housing 11 may support the access terminal 12 such that a lengthwise direction of the access terminal 12 is in parallel with a direction in which the male connector 1 inserts into the female connector 2. The main opening 1*a* and the assistance opening 1*b* may be provided at the front of the cap housing 11. Each of the main opening 1*a* and the assistance opening 1*b* may be sealed by internally inserted seal. The main opening 1*a* may communicate with a terminal hole H1 to be described below. When the main opening 1*a* is sealed, water or foreign substances may be prevented from flowing from the outside into the terminal hole H1. The assistance opening 1*b* may be an opening through which a cable passes. The cap housing 11 may include a cap body 111, a cap head 112, the capture protrusion 113 corresponding to the fastening structure, and a cap guide 114.

The cap body 111, as shown in FIGS. 4-8, forms an external appearance of the cap housing 11. An internal shape of the cap body 111 may correspond to an external appearance shape of the connecting part 13. Here, the cap body 111 may assist 1 degree of freedom (1 DoF) sliding of the connecting part 13. The cap body 111 may include the terminal hole H1 for supporting the access terminal 12. The cap body 111 may include a core hole for forming the fastening structure; the cap body 111 may include the core hole H2 for forming a protrusion head 1132 of the cap protrusion 113. The terminal hole H1 and the core hole H2 may penetrate and thereby be formed in the cap body 111. The access terminal 12 may insert into the terminal hole H1, and the access terminal 12 inserted into the terminal hole H1 may be supported by the cap body 111. A number of terminal holes H1 may be formed based on a number of access terminals 12. The core hole H2 may be a hole that is formed in response to insertion of a core to form the cap protrusion 113 in an undercut shape during an injection molding process. As described below, the cap protrusion 113 may include a protrusion body 1131 configured to protrude upward from the cap body 111 and a protrusion head 1132 configured to protrude sideward from the protrusion body 1131. To form the protrusion head 1132, the core hole H2 that penetrates the cap body 111 is essentially formed. Likewise, a number of core holes H2 corresponding to a number of cap protrusions 113 may be formed.

The core hole H2, as shown in FIGS. 6-8, may be positioned within a waterproof area for waterproofing the inside of the cap body 111 based on a direction in parallel with the lengthwise direction of the access terminal 12. The waterproof area refers to an area in which, for example, the seal is provided to prevent fluid from flowing from the outside into the cap body 111. The seal may be provided to the main opening 1*a* and/or the assistance opening 1*b* and may prevent fluid from flowing into the cap body 111 through the main opening 1*a* or the assistance opening 1*b*. Referring to FIG. 7, the seal may be provided at a position at which the terminal hole H1 and the core hole H2 may cover the entire main opening 1*a* corresponding to the waterproof area. For example, when the cap housing 11 includes the cap head 112 to be described below, the main opening 1*a* may be defined by the edge of the cap head 112 and the core hole H2 may be provided in the cap head 112.

In another embodiment, when the entire size of the access terminal 12 is relatively large, the cap housing 11 may not include the cap head 112. In this case, the waterproof area may be the terminal hole H1 into which the access terminal 12 inserts and also may be an area in which the seal for preventing the fluid from flowing along the terminal hole H1 is provided. A portion of an edge of the terminal hole H1 may function as the core hole H2. For example, the core hole H2 may be provided within a distance separate between the access terminal 12 and an inner side of the terminal hole H1 based on the lengthwise direction of the access terminal 12. According to the above structure, a separate configuration for waterproofing the core hole H2 is not required.

The cap head 112 may protrude from the cap body 111 and may form the main opening 1*a*, as shown in FIGS. 6 and 7. The cap head 112 may surround the access terminal 12. The cap head 112 may protrude in a direction (+x-axial direction) opposite to a direction (hereinafter, also referred to as a coupling direction of the male connector 1 with respect to the female connector 2) in which the male connector 1 couples with the female connector 2. The cap head 112 may guide an electronic part to stably couple with the connector assembly 100.

The cap protrusion 113 corresponding to the fastening structure may fasten the connecting part 13 that is provided in the cap body 111, as shown in FIGS. 4-6. The cap protrusion 113 may be separate further away from an inner wall of the cap housing 11 rather than the support rod 132. Accordingly, the core hole H2 may be formed to be relatively close to a center. In addition, the cap protrusion 113 is only a configuration that configures to fasten the connecting part 13 and a configuration, for example, the support rod 132, configured to support the protection part 14 is separately provided to the connecting part 13. Accordingly, the connector assembly 100 may be in a compact structure.

The cap protrusion 113 may penetrate the slider 16 and fasten the connecting part 13, as shown in FIGS. 4-6. While the cap protrusion 113 limits movement of the connecting part 13 in a widthwise direction (y-axial direction or z-axial direction) of the connector assembly 100, the cap protrusion 113 does not limit movement of the slider 16. The cap protrusion 113 may include the protrusion body 1131 configured to protrude from the cap body 111 in a direction opposite to a direction in which the cap body 111 protrudes and the protrusion head 1132 configured to protrude from the protrusion body 1131 and to fasten the connecting part 13. The protrusion body 1131 may protrude in the coupling direction (−x-axial direction) of the male connector 1 with respect to the female connector 2. The protrusion head 1132 may protrude from the protrusion body 1131 in a direction intersecting a direction in which the protrusion body 1131 protrudes. The connecting part 13 may include a connecting part groove configured to accommodate the protrusion head 1132 when the connecting part 13 is fully accommodated in the cap body 111.

A plurality of cap protrusions 113 may be provided as shown in FIGS. 4-6. A portion of the plurality of cap protrusions 113 may be formed to face each other based on the terminal hole H1 and may support another portion of the connecting part 13. In the embodiment shown in FIG. 6, four cap protrusions 113 may be provided. Two cap protrusions 113 may be formed in a +z-axial direction based on the terminal hole H1 and other two cap protrusions 113 may be formed in a −z-axial direction based on the terminal hole H1.

The protrusion body 1131, shown in FIG. 6, may be deformed due to interference with the connecting part 13. The protrusion head 1132 may include an upper portion in a planar surface and may include a surface inclined from the upper portion toward a lower portion of the protrusion head 1132. A length of the protrusion head 1132 that protrudes from the protrusion body 1131 may increase with getting downward from an upper end of the protrusion body 1131. According to the above structure, while the connecting part 13 is descending along the cap body 111, the cap protrusion 113 may interfere with the connecting part 13 and be deformed on an outside of the cap protrusion 13. When the connecting part 13 is fully accommodated in the cap body 111, the cap protrusion 113 may restore to an original state and may fasten the connecting part 13.

A thickness of the protrusion body 1131 of the cap protrusion 113 is greater than a thickness of a portion farther away from the cap body 111, that is, the protrusion head 1132. Therefore, the core hole H2 may be formed in the cap body 111. As shown in FIG. 7, the core hole H2 may penetrate and thereby be formed below the protrusion head 1132. The core hole H2 may be surrounded by the cap head 112 based on a state in which the core hole H2 faces the cap body 111 in a direction in parallel with the terminal hole H1. That is, the core hole H2 may be formed inward of the cap head 112. When the core hole H2 is formed inward of the cap head 112 and, in this instance, the cap head 112 is sealed by the seal, the core hole H2 as well as the terminal hole H1 may be sealed. The cap protrusion 113 is not a configuration configured to directly interact with the protection part 14 but a configuration configured to fasten the connecting part 13 and thus, may be formed to be separate from an inner side surface of the cap body 111. The support rod 132 of the connecting part 13 that is a configuration configured to directly interact with the protection part 14 may be formed at a most outward edge of the connecting part 13 and may assist a sufficient space to be provided inside the protection part 14.

Figure 9:
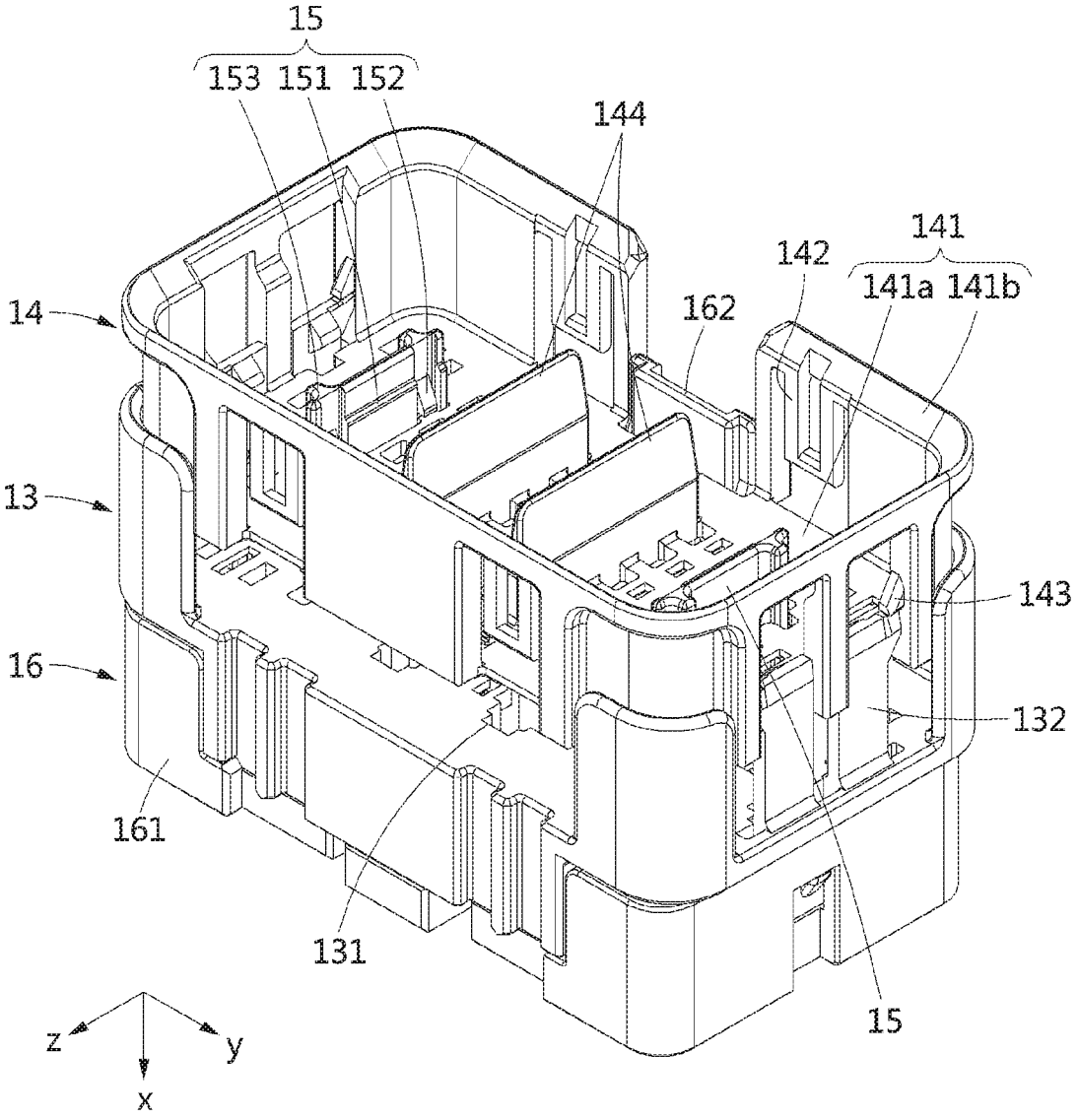
FIG. 9 is a perspective view of a connecting part, a protection part, and a slider of the male connector.

The cap guide 114 may interfere with a locking member 142 of the protection part 14, as shown in FIGS. 6 and 9. The cap guide 114 may protrude from the inner wall of the cap housing 11 and may be formed at a height less than a height of the inner wall. While the protection part 14 is being supported by the support rod 132 of the connecting part 13, the cap guide 114 may be separate from the locking member 142. When the protection part 14 descends along the connecting part 13 without being supported by the support rod 132 of the connecting part 13, the cap guide 114 may maintain the locking member 142 not to be deformed on the outer side. The locking member 142 may be supported by the cap guide 114 to be prevented from being deformed while the female connector 2 is ascending from the male connector 1 by a desired (or, alternatively, predetermined) distance, and may not be supported by the cap guide 114 to thereby be deformed when the female connector 2 ascends to be above the distance. Accordingly, a plug housing 22 may be separate from the protection part 14.

The access terminal 12 may electrically connect a first electronic part mounted to the male connector 1 and a second electronic part mounted to the female connector 2. The access terminal 12 may be mounted to the cap housing 11. A plurality of access terminals 12 may be provided. A lower end of the access terminal 12 may be exposed in a direction in which the cap head 112 protrudes and an upper end of the access terminal 12 may be exposed in a direction in which the cap protrusion 113 protrudes. The upper end of the access terminal 12 may be supported by the protection part 14.

The connecting part 13 may be provided in the cap housing 11 and may support the protection part 14, as shown in FIGS. 6 and 9. The connecting part 13 may assist the protection part 14 to be vertically movable. Using the connecting part 13, the core hole H2 may be positioned to be adjacent to the terminal hole H1 and may be surrounded by the cap head 112. The protection part 14 may be supported by the support rod 132 that is formed on the edge of the connecting part 13 and may inwardly secure a sufficient space. The connecting part 13 may include a connecting body 131 and the support rod 132.

The connecting part 13, as shown in FIGS. 6 and 9, may include the support rod 132 at a position different from that of the cap protrusion 113. Although the cap protrusion 113 is formed at a relatively center for setting a position of the core hole H2, the connecting part 13 may form the support rod 132 on the edge. According to the above structure, the connector assembly 100 may have a compact structure.

The connecting body 131 may be mounted to the cap housing 11 as shown in FIGS. 6 and 9. The connecting body 131 may include a connecting body groove configured to accommodate the protrusion head 1132 of the cap protrusion 113. Once the connecting body 131 is fully inserted into the cap housing 11, the protrusion head 1132 of the cap protrusion 113 may fasten the connecting body 131. The user may decouple the cap protrusion 113 and the connecting body 131 through an exclusive zig. The connecting body 131 may include a connecting base 131*a* including a hole through which the access terminal 12 passes and a connecting sidewall portion 131*b* configured to protrude upward from an edge of the connecting base 131*a*.

The support rod 132 may support the protection part 14 and may be elastically deformable as shown in FIGS. 6 and 9. The support rod 132 may protrude from the connecting body 131. For example, the support rod 132 may protrude from the connecting base 131*a* to be in parallel with the connecting sidewall portion 131*b*. Based on a state in which the connecting part 13 is mounted to the cap housing 11, the support rod 132 may be separate from the inner sidewall of the cap housing 11. The support rod 132 may include a support body 1321 configured to protrude upward from the connecting body 131 and a support head 1322 configured to protrude from the support board 1321 toward inside of the connecting body 131. Before the male connector 1 inserts into the female connector 2, the support rod 132 may support the protection part 14. While the male connector 1 is being inserted into the female connector 2, the female connector 2 may deform the support rod 132 to the outer side through interference with the support head 1322 and accordingly, the support rod 132 may not support the protection part 14 and the protection part 14 may descend along the connecting part 13. The support rod 132 may be provided at an outside of a boundary defined by the edge of the cap head 112 based on the direction parallel with the lengthwise direction of the access terminal 12.

As shown in FIGS. 4-9, the cap protrusion 113 may be provided inside the plug housing 22 and the support rod 132 may be provided outside the plug housing 22, based on the direction parallel with the lengthwise direction of the access terminal 12. The protection part 14 may support a tip portion of the upper end of the access terminal 12 and may protect the access terminal 12 such that the access terminal 12 may be properly aligned with the female connector 2 and the access terminal 12 may not be damaged. The protection part 14 may be vertically movable along the connecting part 13. For example, while the protection part 14 is being supported by the support rod 132 of the connecting part 13, movement of the protection part 14 may be limited. When the female connector 2 pushes the support rod 132 to an outer side, the protection part 14 may descend relative to the connecting part 13. While the female connector 2 is being separate from the male connector 1, the protection part 14 may interfere with the female connector 2 and may ascend relative to the connecting part 13. The protection part 14 may include a protection body 141, the locking member 142, a support protrusion 143, and a protection guide 144.

The protection body 141 may be supported by the support rod 132 and may maintain a position separate from the connecting body 131, as shown in FIG. 9. That the protection body 141 is present at the position separate from the connecting body 131 indicates that the protection body 141 and the connecting body 131 are separate from each other in the lengthwise direction of the access terminal 12. The protection body 141 may include a hole for supporting the access terminal 12 and may be supported by the support rod 132. The protection body 141 may be supported by the support rod 132 with being separate from the connecting body 131 in the lengthwise direction of the access terminal 12. The protection body 141 may include a protection base 141*a* including a hole through which the access terminal 12 passes and a protection sidewall portion 141*b* configured to protrude upward from an edge of the protection base 141*a*. The protection base 141*a* may be separate from the connecting base 131*a* in the lengthwise direction of the access terminal 12. The female connector 2 may insert into the protection sidewall portion 141*b* and may pressurize the protection base 141*a* toward the connecting base 131*a*.

The locking member 142 may be formed on the protection body 141 to be elastically deformable. The locking member 142 may interfere with the female connector 2. While the female connector 2 is being mounted to the male connector 1, as shown in FIGS. 4 and 5, the locking member 142 may be deformed to an outer side such that the female connector 2 may pass. While the female connector 2 is separate from the male connector 1, the deformation of the locking member 142 to the outer side may be limited by way of the cap guide 114 and may ascend with the female connector 2. Interference between the locking member 142 and the female connector 2 will be further described with reference to FIGS. 11-13. The locking member 142 may protrude from an upper end edge of the protection sidewall portion 141*b* to be in parallel with a direction in which the protection sidewall portion 141*b* protrudes. For example, the locking member 142 may protrude upward or downward from the upper end edge of the protection sidewall portion 141*b*.

As shown in FIGS. 4-9, the support protrusion 143 may protrude sideward from the protection sidewall portion 141*b* and may contact a top surface of the support rod 132. By way of the support protrusion 143, the protection base 141*a* may maintain a state separate upward from the connecting base 131*a*. The protection guide 144 may assist alignment of the female connector 2 relative to the protection part 14. The protection guide 144 may protrude from the protection base 141*a* in the lengthwise direction of the access terminal 12.

The coupling part 15 may be temporarily deformed while the protection part 14 is being mounted to the connecting part 13 and may return to an original shape when the protection part 14 is mounted to the connecting part 13, thereby coupling the connecting part 13 and the protection part 14. For example, the coupling part 15 may protrude from the connecting part 13 and may protect the protection part 14 from being separate from the connecting part 13. In a state in which the connecting part 13 and the protection part 14 are coupled through the coupling part 15, the protection part 14 may ascend or descend within a desired (or, alternatively, predetermined) distance with respect to the connecting part 13.

The coupling part 15, as shown in FIG. 6, may include a coupling body 151, a coupling protrusion 152, and a coupling guide 153. The coupling body 151 may protrude from the connecting body 131 and may pass through the protection body 141. The coupling body 151 may function to align the connecting body 131 and the protection body 141. For example, the coupling body 151 may be in an elongated plate shape in a widthwise direction (y-axial direction or z-axial direction) of the connecting body 131, and the protection body 141 may include a hole in a corresponding shape to allow the coupling body 151 to pass. When the coupling body 151 enters to fit the hole of the protection body 141, the coupling body 151 and the protection body 141 may be normally coupled.

The coupling protrusion 152 may protrude from the coupling body 151 in a direction that intersects a direction in which the coupling body 151 protrudes. While the protection part 14 is being inserted into the connecting part 13, the coupling part 15 may be deformed due to interference with the protection part 14. Once the protection part 14 passes through the connecting part 13, the coupling part 15 may return to an original shape and may prevent the protection part 14 from being separate from the connecting part 13. A top surface of the coupling protrusion 152 may include an inclined surface. For example, the coupling protrusion 152 that protrudes from the coupling body 151 may have an upwardly decreasing length. Meanwhile, a bottom surface of the coupling protrusion 152 may include a planar surface in parallel with a top surface of the protection base 141*a*. According to the above structure, the protection part 14 may pass the coupling protrusion 152 and be mount to the connecting part 13 through a motion of simply pushing the protection part 14 into the connecting part 13. On the contrary, the protection part 14 may not be readily separate from the connecting part 13 through a motion of simply pulling the protection part 14. The user may need to deform the coupling part 15 using a tool or a finger and to separate the protection part 14 from the connecting part 13.

The coupling guide 153 may protrude from the coupling body 151 in a direction opposite to the direction in which the coupling protrusion 152 protrudes. The coupling guide 153 may assist alignment of the connecting part 13 and the protection part 14 with the coupling body 151. A plurality of coupling guides 153 may be provided to be separate at desired distances. The slider 16 may be a position assurance member (double lock (DBL)) of the connector assembly 100. As described above, to implement the waterproof structure of the connector assembly 100, the core hole H2 is provided to the main opening 1*a*. To provide the core hole H2 to the main opening 1*a*, the cap protrusion 113 needs to be separate from the inner sidewall of the cap housing 11 by a desired (or, alternatively, predetermined) distance. To achieve the compact structure with the waterproof structure of the connector assembly 100, the support rod 132 needs to be positioned to be maximally close to the inner sidewall of the cap housing 11. Therefore, the connector assembly 100 includes the connecting part 13 that is a configuration separate from the cap housing 11 and the protection part 14. Although the connecting part 13 is fastened to the cap housing 11, the slider 16 may perform the position assurance member (DBL) functionality of the connector assembly 100 without a structural difficulty. Hereinafter, the slider 16 will be further described.

As shown in FIGS. 4-6 and 9, the slider 16 may be provided to be slidable relative to the connecting part 13 and may prevent the access terminal 12 from being deviated, that is, separate from the connecting part 13. For example, the slider 16 may slide in one direction (+z-axial direction) relative to the connecting body 131 and thereby insert into the access terminal 12, and may slide in a direction (−z-axial direction) opposite to the one direction relative to the connecting body 131 and thereby be separate from the access terminal 12. The access terminal 12 may include a groove configured to accommodate at least a portion of the slider 16. FIG. 4 shows a state in which the slider 16 is inserted into the groove of the access terminal 12. When the slider 16 is inserted into the groove of the access terminal 12, sliding of the slider 16 in the lengthwise direction (x-axial direction) of the access terminal 12 may be limited. Although not illustrated, when the slider 16 slides in the −z-axial direction and is separate from the groove of the access terminal 12, the access terminal 12 may slide in the lengthwise direction (x-axial direction) of the access terminal 12. Since the access terminal 12 is supported by the cap body 111, a fastening state between the slider 16 and the cap body 111 may be maintained unless an external force with predetermined strength or more is applied. The slider 16 may include a slider body 161 and a slider lever 162.

The slider body 161 is slidable along the connecting part 13, as shown in FIGS. 4-9. The slider body 161 may be provided to face the protection part 14 based on the connecting part 13. The connecting part 13 may stably support the protection part 14 in a fastened state and the slider body 161 provided below the connecting part 13 may slide in the z-axial direction and may insert into or be separate from the groove of the access terminal 12.

The slider lever 162 may protrude from the slider body 161, as shown in FIG. 6, and may transmit power applied from the outside to the slider body 161. The user may slide the slider body 161 by applying a force to the slider lever 162. For example, the user may couple the access terminal 12 and the slider body 161 by pulling the slider lever 162 in the +z-axial direction. Also, the user may decouple the access terminal 12 and the slider body 161 by pushing the slider lever 162 in the −z-axial direction. The slider lever 162 may protrude from the slider body 161 and an upper end thereof may pass the protection part 14. The slider lever 162 may be provided to be externally exposed in a state in which the connecting part 13 and the protection part 14 are installed inside the cap housing 11. Referring to FIG. 9, although the slider body 161 is provided below the connecting part 13 and the protection part 14, the upper end of the slider lever 162 may be positioned above the protection part 14. Through the above structure, although the slider body 161 is positioned below the connecting part 13, the user may easily control the slider body 161. A portion of the protection part 14 may be cut to provide a space for exposing the slider lever 162 to the outside. The protection part 14 may allow the slider lever 162 to pass while being in close contact with the inner wall.

The female connector 2 may include the case 21, the plug housing 22, and the connector lever 23, as shown in FIGS. 4 and 5. The case 21 may form an external appearance of the female connector 2. A center portion of the case 21 may be connected at a rear surface of the plug housing 22 and an outskirt portion of the case 21 may be slidable relative to a lateral surface of the cap housing 11. The center portion of the case 21 may support the inner seal 24, which is described below. For example, the inner seal 24 in a ring shape may surround the center portion of the case 21.

The plug housing 22, as shown in FIGS. 4 and 5, may remove a state in which the connecting part 13 and the protection part 14 are fastened to each other while the male connector 1 and the female connector 2 are being coupled with each other. The plug housing 22 may remove the fastening state of the connecting part 13 and the protection part 14 and may push the protection part 14 toward a floor surface of the connecting part 13. Here, the floor surface of the connecting part 13 refers to a surface on which the connecting part 13 is separate from the protection part 14 and faces the protection part 14 in a state in which the protection part 14 is supported by the support rod 132. The plug housing 22 may be mounted to the protection part 14 by connecting at the front of the center portion of the case 21 and by inserting into the cap housing 11.

As shown in FIGS. 11-14, the plug housing 22 may include a plug body 221 configured to be slidable along an inner side of the protection part 14 and a mounting protrusion 222 and a separation protrusion 223 configured to protrude from the plug body 221 in a direction intersecting a direction in which the plug body 221 slides. Further description related to the mounting protrusion 222 and the separation protrusion 223 will be made with reference to FIGS. 11-14.

The connector lever 23, as shown in FIGS. 1-5, may assist coupling or decoupling, that is, separation between the male connector 1 and the female connector 2.

The inner seal 24, shown in FIGS. 4 and 5, may prevent water or foreign substances from flowing into between the case 21 and the cap body 111. The inner seal 24 may be in a ring shape and may surround the case 21. For example, the inner seal 24 may surround the center portion of the case 21. As another example, the inner seal 24 may be provided inside the cap body 111. The inner seal 24 may be provided between the cap housing 11 and the case 21 in a state in which the male connector 1 and the female connector 2 are coupled. The inner seal 24 may be compressed by the inner sidewall of the cap body 111 and an outer sidewall of the case 21. For example, the inner seal 24 may be an O-ring.

Figure 10:
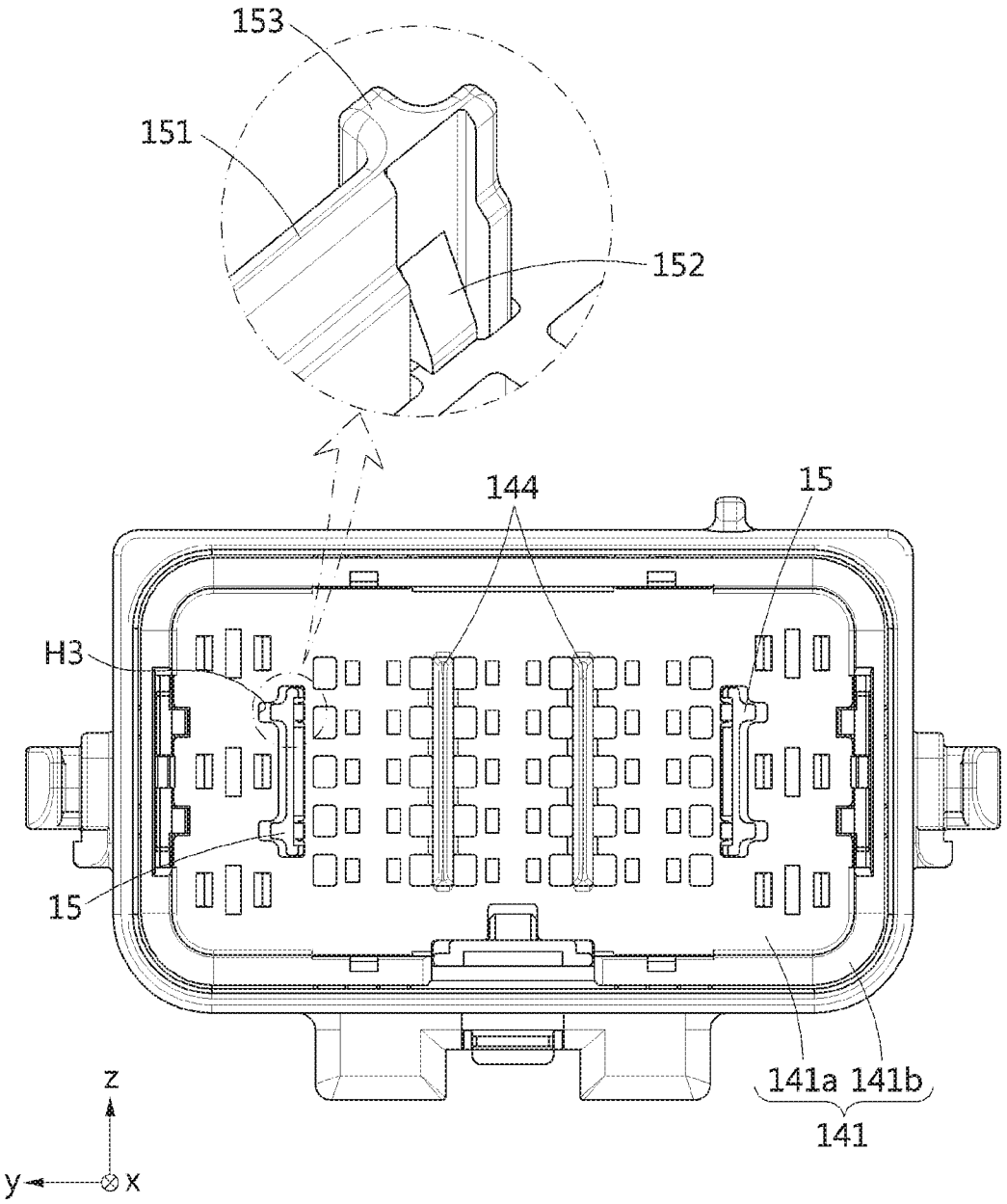
FIG. 10 is a rear view of the male connector.

As shown in FIG. 10, the protection base 141*a* of the protection body 141 may include a protection hole H3 through which the coupling part 15 passes. A shape of the protection hole H3 may correspond to a shape of the coupling part 15. For example, two coupling parts 15 may be provided to face each other inside the protection sidewall portion 141*b*. Also, two protection guides 144 may be provided between the two coupling parts 15. However, it is provided as an example only and a number of coupling parts 15 and a number of protection guides 144 are not limited thereto. The coupling part 15 may be deformed in a direction opposite to a direction in which the coupling protrusion 152 protrudes while the protection body 141 is descending along the coupling part 15. The protection hole H3 may be in a shape for avoiding interference with the coupling body 151 and the coupling guide 153 while the coupling part 15 is being deformed.

Figure 11:
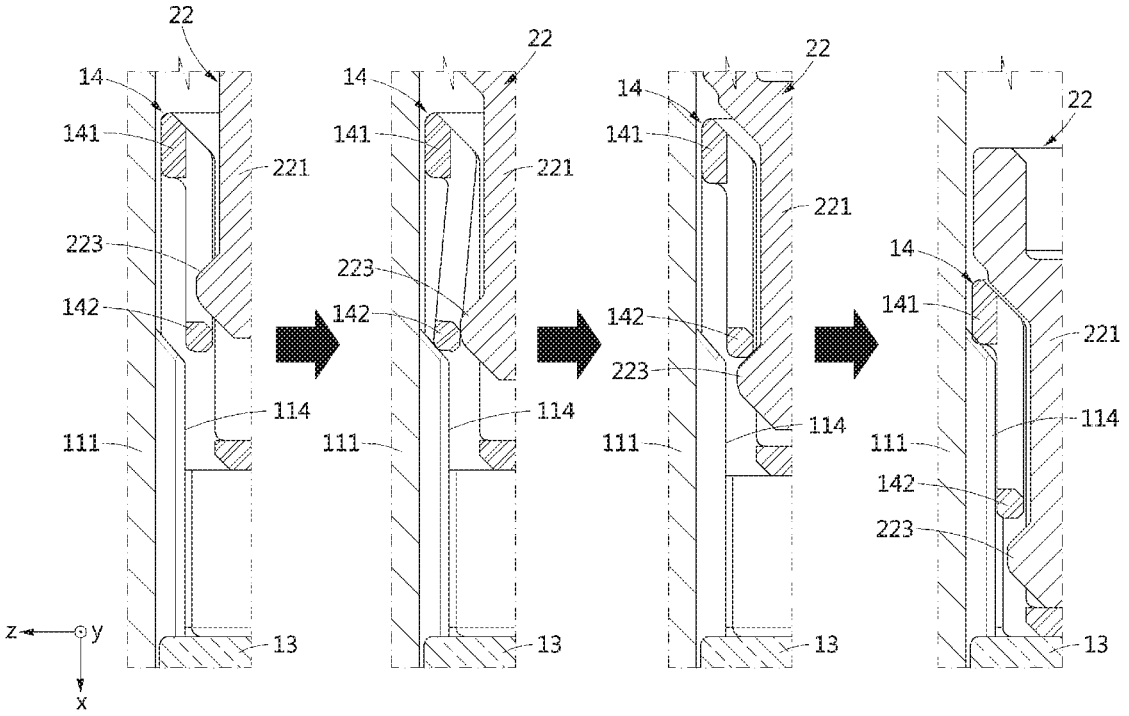
FIG. 11 is a sectional side view of a process in which a locking member and a separation protrusion interact during coupling of the female connector and the male connector.
Figure 12:
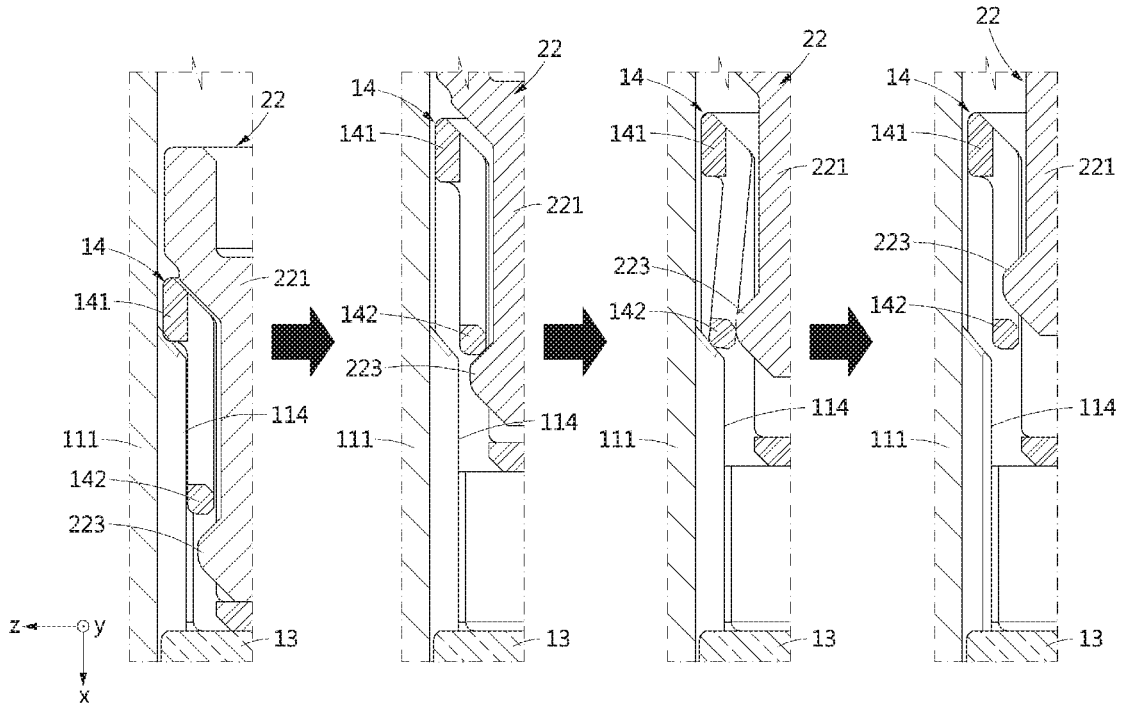
FIG. 12 is a sectional side view of a process in which the locking member and the separation protrusion interact during decoupling of the female connector and the male connector.

FIG. 11 shows a process in which the locking member 142 and the separation protrusion 223 interact during coupling of the female connector 2 and the male connector 1. FIG. 12 shows a process in which the locking member 142 and the separation protrusion 223 interact during decoupling of the female connector 2 and the male connector 1.

As shown in FIGS. 11 and 12, while the plug housing 22 is being inserted inward into the protection part 14, the separation protrusion 223 that protrudes sideward (z-axial direction) from the plug body 221 may pass the locking member 142. In an initial state, that is, while the protection part 14 is being supported by the connecting part 13, the locking member 142 may be separate from the inner sidewall of the cap body 111. Also, the separation protrusion 223 may include an inclined surface on each of a top surface and a bottom surface. According to the above structure, while the plug housing 22 is inserted inward into the protection part 14, the separation protrusion 223 may deform the locking member 142 to the outer side and the plug body 221 may descend. As the plug housing 22 is provided inside the cap housing 11 in this manner, the protection part 14 may be in close contact with the connecting part 13.

Meanwhile, as shown in FIGS. 11 and 12, while the plug housing 22 is being separate from the protection part 14, the separation protrusion 223 may be stopped by the locking member 142 and thereby elevate the locking member 142. Since the locking member 142 is supported by the cap guide 114, deformation of the locking member 142 to the outer side may be limited. While the locking member 142 is being supported by the cap guide 114, the plug housing 22 and the protection part 14 may move together. When the protection part 14 ascends to be above the distance and the locking member 142 is not supported by the cap guide 114, the separation protrusion 223 may deform the locking member 142 to the outer side and the plug housing 22 may be separate from the protection part 14.

Figure 13:
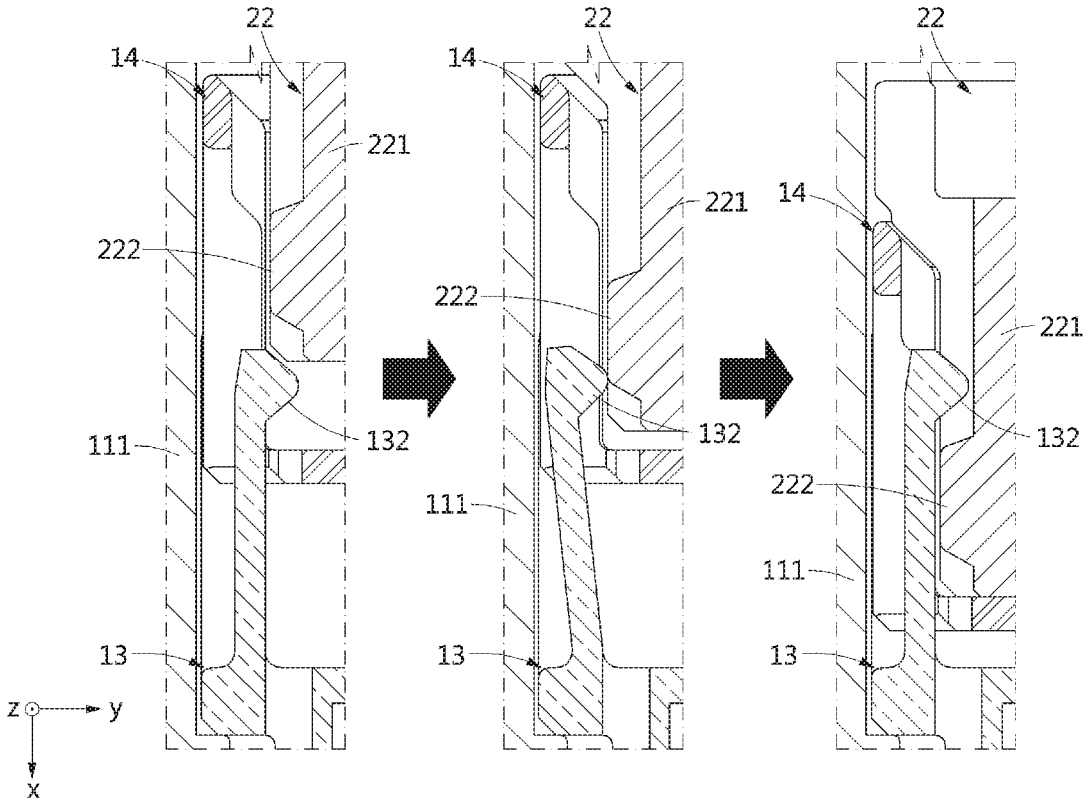
FIG. 13 is a sectional side view of a process in which a support rod and a mounting protrusion interact during coupling of the female connector and the male connector.
Figure 14:
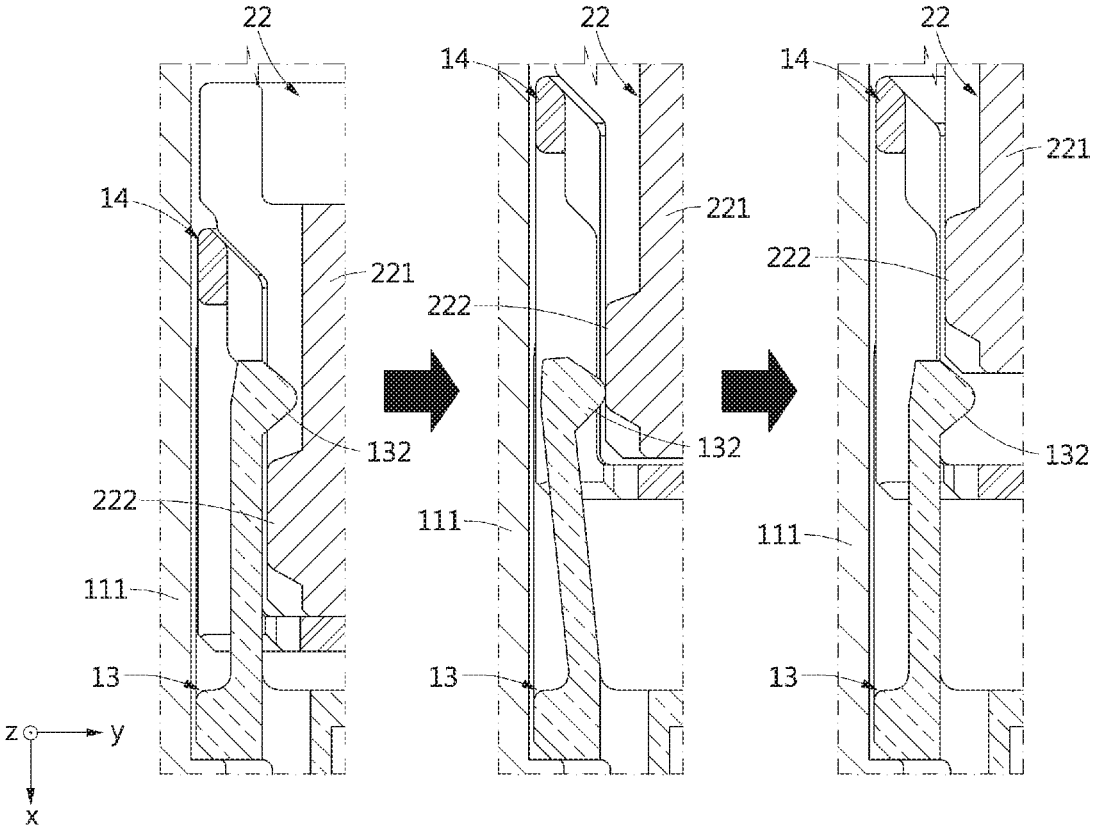
FIG. 14 is a sectional side view of a process in which the support rod and the mounting protrusion interact during coupling of the female connector and the male connector.

FIG. 13 shows a process in which the support rod 132 and the mounting protrusion 222 interact during coupling of the female connector 2 and the male connector 1. FIG. 14 shows a process in which the support rod 132 and the mounting protrusion 222 interact during coupling of the female connector 2 and the male connector 1.

The plug housing 22, as shown in FIGS. 13 and 14, may include the mounting protrusion 222 configured to protrude from the plug body 221 and to be capable of deforming the support rod 132. The mounting protrusion 222 may protrude from the plug body 221 and may deform the support rod 132 during a process in which the plug body 221 inserts inward into the protection part 14, such that the protection part 14 may descend toward the connecting part 13. The mounting protrusion 222 may include, for example, an inclined surface on each of a top surface and a bottom surface. The mounting protrusion 222 may deform the support rod 132 to the outer side while the plug body 221 is sliding along the inner side of the protection part 14. When the support rod 132 is deformed by the mounting protrusion 222, the support rod 132 may not support the protection part 14 and the protection part 14 may descend and may be in close contact with the connecting part 13. The mounting protrusion 222 may include an inclined part on each on an upper side and a lower side.

Figure 15:
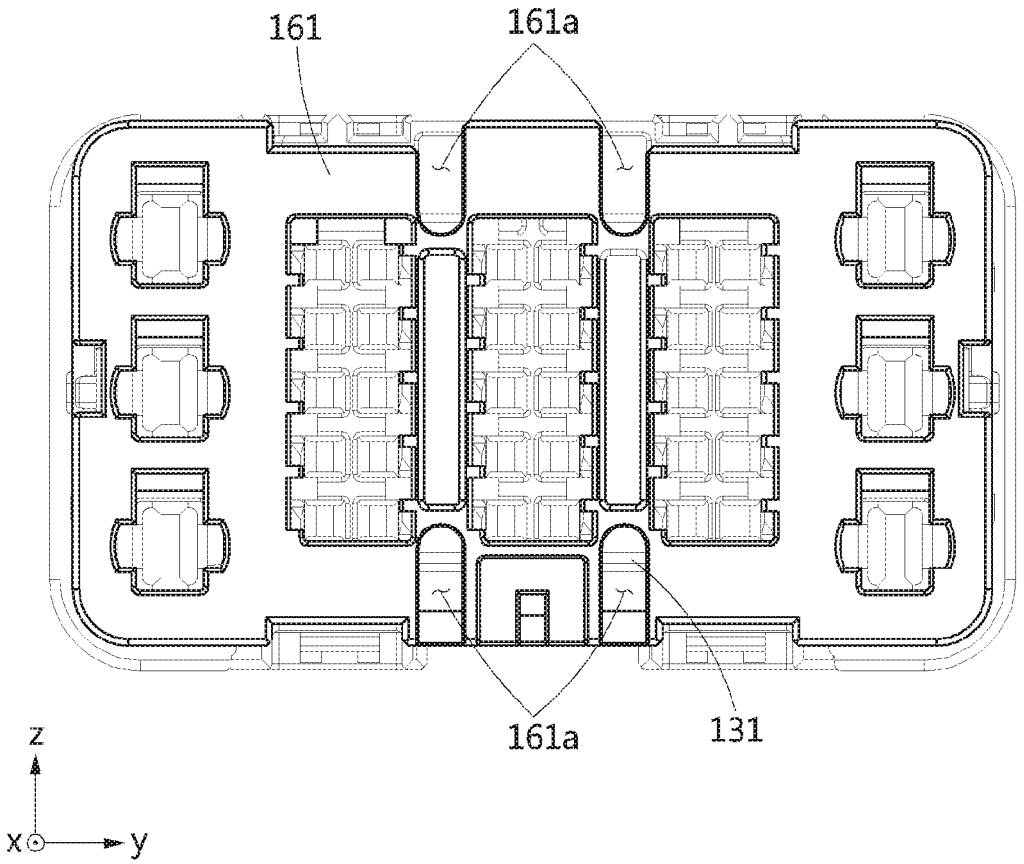
FIG. 15 is a bottom view of the male connector.
Figure 16:
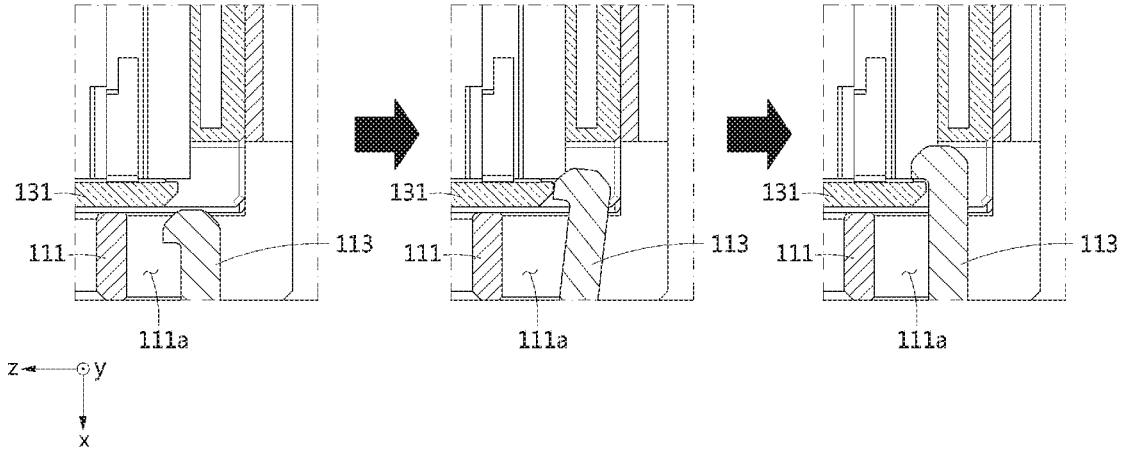
FIG. 16 shows a process in which a cap protrusion fastens to a connecting part during coupling of the cap protrusion and the connecting part.

As shown in FIG. 15, the slider body 161 may include a slider hole 161*a* to avoid interference with the cap protrusion 113. The slider hole 161*a* may be formed in a direction in which the slider body 161 slides. The cap protrusion 113 may penetrate the slider body 161 and be deformed due to interference with the connecting body 131 while the connecting part 13 is being mounted to the cap housing 11 as shown in FIG. 16. When the connecting part 13 is fully mounted to the cap housing 11, the cap protrusion 113 may return to an original state and may prevent the connecting part 13 from being separate from the cap housing 11.

Figure 17:
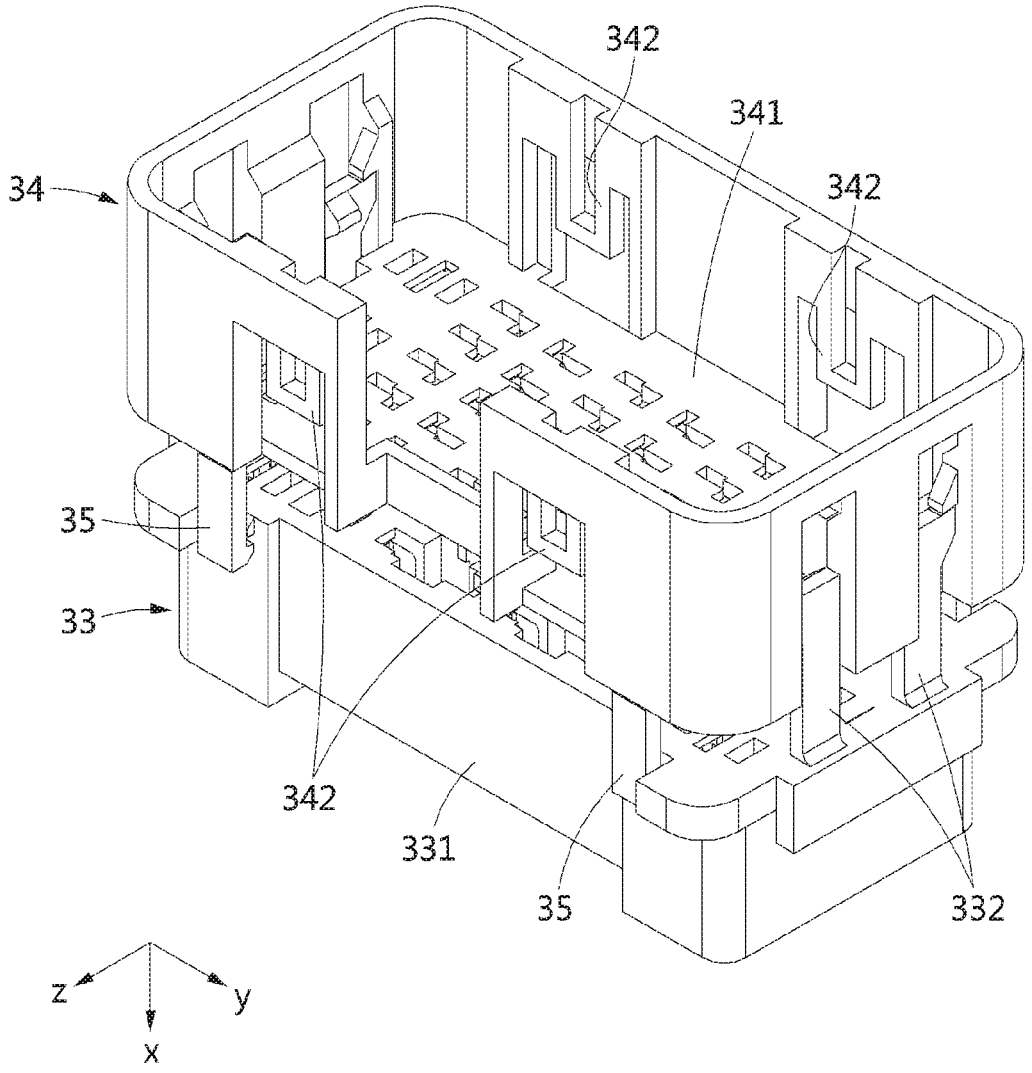
FIG. 17 is a perspective view of a connecting part and an assistance part of a connector according to an embodiment.

As shown in FIG. 17, a connecting part 33 may include a connecting body 331 and a support rod 332. A protection part 34 may include a protection body 341 and a locking member 342. A coupling part 35 may couple the protection part 34 and the connecting part 33 in such a manner that the coupling part 35 protrudes from the protection body 341 and is stopped by the connecting body 331. Also, the coupling part 35 may protrude from the protection part 34 and may prevent the connecting part 33 from being separate from the protection part 34. The coupling part 35 may be formed on an edge of the protection body 341. Each of a plurality of coupling parts 35 may be mounted to a different portion of the connecting part 33. A bottom surface of the coupling part 35 may include an inclined surface. The coupling part 35 may be deformed to an outer side while the connecting part 33 and the protection part 34 are being coupled, and may return to an original state when the connecting part 33 moves along the protection part 34 by a desired (or, alternatively, predetermined) distance. The user may couple the connecting part 33 and the protection part 34 by sliding the connecting part 33 along the protection part 34. Although the connecting part 33 and the protection part 34 are coupled through the coupling part 35, the connecting part 33 and the protection part 34 may relatively move by a desired (or, alternatively, predetermined) distance.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A connector assembly, comprising:

a male connector including:

a cap housing, the cap housing being formed to accommodate an access terminal;

a connecting part including a support structure fixably mounted in the cap housing; and a protection part engaging with and supported by the support structure of the connecting part within the cap housing and configured to be movable relative to the connecting part in a lengthwise direction of the access terminal; and a female connector including a plug housing configured to be inserted in the cap housing, the plug housing is configured to release a fastening state between the connecting part and the protection part and to push the protection part toward a floor surface of the connecting part during coupling of the male connector and the female connector.

2. The connector assembly of claim 1, wherein the cap housing includes a cap body having a terminal hole configured to support the access terminal and a fastening structure provided in the cap body and configured to fasten the connecting part, the connecting part arranged between the protection part and the cap body, the cap housing and the connecting part are manufactured as separate members and then assembled.

3. The connector assembly of claim 2, wherein the connecting part is configured to be fastened by the fastening structure and to be immovable relative to the cap housing as the protection part moves relative to the cap housing.

4. The connector assembly of claim 3, wherein the cap body has a core hole configured to form the fastening structure, the core hole is provided in a waterproof area for waterproofing an inside of the cap body in a direction parallel with the lengthwise direction of the access terminal.

5. The connector assembly of claim 4, wherein the cap housing includes a cap head configured to protrude from the cap body and to surround the access terminal, the core hole is provided in a boundary defined by an edge of the cap head in the direction parallel with the lengthwise direction of the access terminal.

6. The connector assembly of claim 1, wherein the support structure of the connecting part includes a support rod configured to be elastically deformable.

7. The connector assembly of claim 6, wherein the plug housing includes a plug body configured to be inserted into the protection part and a mounting protrusion configured to protrude from the plug body and to deform the support rod when the plug body is inserted into the protection part.

8. The connector assembly of claim 1, wherein the protection part has a locking member and the plug housing has a separation protrusion configured to be stopped by the locking member and to elevate the protection part.

9. The connector assembly of claim 8, wherein the cap housing has a cap guide configured to protrude from an inner wall at a height less than a height of the inner wall.

10. The connector assembly of claim 9, wherein the locking member is configured to be supported by the cap guide and not deformed while the male connector is ascending from the female connector by a desired distance and to not be supported by the cap guide and deformed when the male connector ascends to be above the desired distance, separating the plug housing from the protection part.

11. The connector assembly of claim 1, further comprising a coupling part configured to prevent the protection part from separating from the connecting part.

12. The connector assembly of claim 1, wherein the male connector includes a slider configured to be slidable relative to the connecting part and to prevent the access terminal from separating from the connecting part.

13. A connector assembly, comprising:

a male connector including:

a cap housing, the cap housing being formed to accommodate an access terminal;

a connecting part fixably mounted in the cap housing;

a slider configured to be slidable relative to the connecting part and to prevent the access terminal from separating from the connecting part, wherein the slider has a slider body and a slider lever configured to protrude from the slider body in order to transmit power from an outside to the slider body; and a protection part configured to be movable relative to the connecting part in a lengthwise direction of the access terminal; and a female connector including a plug housing configured to insert in the cap housing, the plug housing is configured to release a fastening state between the connecting part and the protection part and to push the protection part toward a floor surface of the connecting part during coupling of the male connector and the female connector.

14. The connector assembly of claim 13, wherein the cap housing has a fastening structure configured to penetrate the slider body and to fasten the connecting part to the cap housing.

15. The connector assembly of claim 14, wherein the slider body has a slider hole configured to avoid interference with the fastening structure during sliding.

16. The connector assembly of claim 15, wherein a portion of the protection part has a cut to provide space for exposing the slider lever to the outside.

17. A male connector, comprising:

a cap housing having a cap body and a fastening structure provided in the cap body, the cap housing being formed to accommodate an access terminal;

a connecting part including a connecting body and a support rod configured to protrude from the connecting body and to be elastically deformable, the connecting body and the support rod are manufactured as a member separate from the cap housing and assembled so as to be arranged within the cap housing; and a protection part provided in the cap housing and configured to engage with and be supported by the support rod, the protection part ascends or descends relative to the cap housing, the connecting part is arranged between an area of the cap housing formed to accommodate the access terminal and the protection part and configured to be immovable relative to the cap housing by the fastening structure that fastens the cap housing and the connecting part to each other.

18. The male connector of claim 17, further comprising a coupling part configured to prevent the protection part from separating from the connecting part.

19. The male connector of claim 17, wherein the cap body has a core hole configured to form the fastening structure, the core hole is provided in a waterproof area for waterproofing an inside of the cap body in a direction parallel with a lengthwise direction of the access terminal.

20. The male connector of claim 17, further comprising a slider configured to be slidable relative to the connecting part and to prevent the access terminal from separating from the connecting part.

* * * * *